US009013118B2

(12) United States Patent
Barnett

(10) Patent No.: US 9,013,118 B2
(45) Date of Patent: Apr. 21, 2015

(54) LED CONTROL SYSTEM WITH A CONSTANT REFERENCE CURRENT

(71) Applicant: Texas Instruments Incorporated, Dallas, TX (US)

(72) Inventor: Raymond E. Barnett, Farmington, MN (US)

(73) Assignee: Texas Instruments Incorporated, Dallas, TX (US)

( * ) Notice: Subject to any disclaimer, the term of this patent is extended or adjusted under 35 U.S.C. 154(b) by 155 days.

(21) Appl. No.: 13/762,013

(22) Filed: Feb. 7, 2013

(65) Prior Publication Data

US 2013/0214700 A1 Aug. 22, 2013

Related U.S. Application Data

(60) Provisional application No. 61/600,189, filed on Feb. 17, 2012.

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***H05B 33/08*** | (2006.01) |

(52) U.S. Cl.

CPC ..... *H05B 33/0851* (2013.01); *H05B 33/0827* (2013.01)

(58) Field of Classification Search

CPC ..... H05B 33/0815; H05B 33/0827; H05B 37/029; H05B 41/3927; B23K 9/0671; B23K 9/0732

USPC ..... 315/297, 301, 307

See application file for complete search history.

(56) References Cited

U.S. PATENT DOCUMENTS

| | | | | |
|---|---|---|---|---|
| 2010/0033110 | A1* | 2/2010 | Chien | 315/294 |
| 2010/0219773 | A1* | 9/2010 | Nakai | 315/307 |
| 2011/0001433 | A1* | 1/2011 | Lee et al. | 315/185 R |
| 2013/0147362 | A1* | 6/2013 | Lee et al. | 315/122 |
| 2013/0200800 | A1* | 8/2013 | Waser | 315/121 |
| 2014/0111702 | A1* | 4/2014 | Luo et al. | 348/739 |

* cited by examiner

*Primary Examiner* — Dylan White

(74) *Attorney, Agent, or Firm* — Alan A. R. Cooper; Frank D. Cimino

(57) ABSTRACT

One embodiment includes a light-emitting diode (LED) control system. The system includes an LED driver system configured to regulate a control voltage based on a substantially constant reference current and a feedback voltage at a feedback node. The system also includes a digital current source system comprising a plurality of unit current sources that are each coupled to an LED. The plurality of unit current sources can be selectively activated to each provide a given unit current through the LED and to each provide the feedback voltage as an interpolative feedback to the feedback node based on the unit current. The system further includes a current magnitude controller configured to selectively activate the plurality of unit current sources in response to a current magnitude signal.

18 Claims, 3 Drawing Sheets

LED CONTROL SYSTEM WITH A CONSTANT REFERENCE CURRENT

CROSS-REFERENCE TO RELATED APPLICATION

This application claims the benefit of U.S. Provisional Patent Application 61/600,189 filed on Feb. 17, 2012, entitled LINEAR WLED DRIVER WITH DAC PROGRAMMABILITY, LOW DROPOUT VOLTAGE AND WIDE OUTPUT VOLTAGE RANGE, the entirety of which is incorporated by reference herein.

TECHNICAL FIELD

The present invention relates generally to electronic circuit systems, and specifically to an LED control system.

BACKGROUND

Light-emitting diodes (LEDs) are implemented for a variety of purposes in electronic device applications. As one example, when implemented for backlight applications in a portable electronic device, such as in a wireless communication device or tablet computer, dimming control can be implemented to preserve battery power, such as in a standby mode or when time has elapsed without an input to the touchscreen. Dimming control can often be based on both user and feature settings. Dimming control can, for example, be based on controlling a current through a given LED. Such current control can be implemented to provide the current control and regulation for a variety of current settings to accommodate the dimming control, as well as to mitigate power consumption and to be able to withstand a variety of design constraints, such as to maintain a certain minimum voltage at a given package pin and to maintain a peak accuracy in current regulation.

SUMMARY

One embodiment includes a light-emitting diode (LED) control system. The system includes an LED driver system configured to regulate a control voltage based on a substantially constant reference current and a feedback voltage at a feedback node. The system also includes a digital current source system comprising a plurality of unit current sources that are each coupled to an LED. The plurality of unit current sources can be selectively activated to each provide a given unit current through the LED and to each provide the feedback voltage as an interpolative feedback to the feedback node based on the unit current. The system further includes a current magnitude controller configured to selectively activate the plurality of unit current sources in response to a current magnitude signal.

Another aspect of the invention includes a method for controlling an LED. The method includes generating a reference voltage based on a substantially constant reference current and receiving a feedback voltage from each activated one of a plurality of unit current sources as an interpolative feedback at a feedback node. The method also includes generating a control voltage based on a difference between the reference voltage and the feedback voltage at the feedback node and selectively activating the plurality of unit current sources in response to a current magnitude signal. The method further includes providing a given unit current through the LED for each activated one of the plurality of unit current sources.

Another aspect of the invention includes an LED control system. The system includes an LED driver system configured to regulate a control voltage based on comparing a reference voltage with a feedback voltage at a feedback node. The reference voltage can be generated based on a substantially constant reference current provided through a reference resistor. The system also includes a current magnitude controller configured to generate a first digital signal and a second digital signal based on a current magnitude signal. The system further includes a digital current source system comprising a plurality of unit current sources that are each coupled to an LED, the plurality of unit current sources being arranged in a two-dimensional array comprising a plurality of rows and a plurality of columns. The plurality of rows can be selectively activated based on the row activation signals and the plurality of unit current sources in each activated one of the plurality of rows can be selectively activated based on the column activation signals to each provide a given unit current through the LED and to each provide the feedback voltage as an interpolative feedback to the feedback node based on the given unit current being provided through a sense resistor in each activated one of the plurality of unit current sources. The reference resistor and the sense resistor of each of the plurality of unit current sources can have relative resistance magnitudes that are proportional.

DETAILED DESCRIPTION

This disclosure relates generally to electronic circuit systems, and specifically to an LED control system. The LED control system can include a driver system that is configured to regulate a control voltage based on a reference voltage and a feedback voltage. The reference voltage can be generated based on a substantially constant reference current being provided through a reference resistor, and the feedback voltage can be provided from each of a plurality of unit current sources at a feedback node. The LED control system can also include a digital current source system that includes the plurality of unit current sources coupled to an LED. Each of the unit current sources can be selectively activated to provide a given unit current through the LED to control the brightness of the LED. The LED control system can further include a current magnitude controller that is configured to provide the selective activation of the unit current sources based on a current magnitude signal.

The unit current sources can be arranged in a two-dimensional array of rows and columns. As an example, each of the rows can be associated with a given specific maximum current setting of the LED, such as defined by the current magnitude signal (e.g., a portion of the current magnitude signal). Thus, a given number of unit current sources in each of the rows can be activated to provide dimming as a portion of the set maximum current through the LED. The unit current sources can each include a switch that is activated to provide the unit current flow through the LED. The unit current flow can also flow through a sense resistor in each of the unit current sources, with the sense resistor being configured to provide the feedback voltage to a feedback node in the driver system. Accordingly, the control voltage can be accurately regulated for each of the unit current sources.

Figure 1:
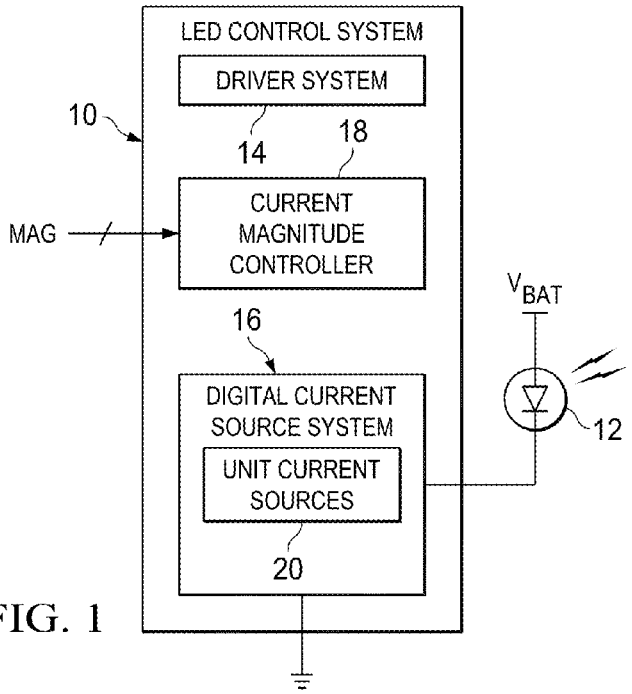
FIG. 1 illustrates an example of an LED control system in accordance with an aspect of the present invention.

FIG. 1 illustrates an example of an LED control system 10 in accordance with an aspect of the present invention. The LED control system 10 can be configured to control a brightness of an LED 12, such as by regulating a current flow through the LED 12. As an example, the LED 12 can be implemented in a variety of electronic applications. For example, the LED 12 can be one of a plurality of LEDs, such as implemented in a backlighting application for a portable electronic device, such as a laptop computer, a tablet computer, or a portable communication device. As an example, the LED control system 10 can be implemented in an integrated circuit (IC) package to control an external one or more LEDs, such as including the LED 12.

The LED control system 10 includes a driver system 14, a digital current source system 16, and a current magnitude controller 18. The driver system 14 is configured to generate a control voltage based on a relative magnitude of a reference voltage and a feedback voltage. As an example, the driver system 14 can include an error amplifier that provides the control voltage based on the reference voltage and the feedback voltage. The reference voltage can be generated, for example, based on providing a substantially constant reference current through a reference resistor.

The digital current source system 16 can include a plurality of unit current sources 20. The unit current sources 20 can each be arranged substantially the same, such that the unit current sources 20 can each be selectively activated to provide a given unit current flow through the LED 12. As a result, the current through the LED 12 can be a digital current magnitude based on the number of activated unit current sources 20. As an example, the unit current sources 20 can be arranged in a two-dimensional array that includes a plurality of rows and columns. Each row of the array of unit current sources 20 can correspond to a gradation of a maximum current setting through the LED 12, such that the maximum current that can flow through the LED 12 at a given time can be set based on the number of activated rows. Therefore, a number of the unit current sources 20 that are activated in each of the activated rows of the array can correspond to a portion of the set maximum current through the LED 12 to provide dimming of the LED 12.

The selective activation of the unit current sources 20 can be provided by the current magnitude controller 18 based on a current magnitude signal MAG. As an example, the current magnitude signal MAG can include a maximum current setting component and a dimming component, such that the current magnitude controller 18 can activate a number of rows of the two-dimensional array of the unit current sources 20 based on the maximum current component, and can activate a plurality of the unit current sources 20 across the activated rows to provide the current flow through LED 12 as a portion of the maximum current through the LED 12, as dictated by the number of activated rows. Therefore, the current magnitude controller 18 and the digital current source system 16 can implement a simple control scheme for maximum current and dimming of the LED 12 by activating each of the unit current sources 20 in a column across all activated rows.

The unit current sources 20 can each include a current switch that is activated by the control voltage regulated by the driver system 14. In response to activation of the current switch, the given unit current can be caused to flow from a battery voltage $V_{BAT}$ through the LED 12 and through a sense resistor in the given one of the unit current sources 20. The sense resistor can thus be arranged to generate the feedback voltage based on the flow of the given unit current across the sense resistor. The feedback voltage of each of the activated unit current sources 20 can be provided to the feedback node to be provided as the feedback voltage at the driver system 14 for regulating the control voltage. Therefore, the feedback voltage can be an interpolative feedback based on the distributed sense resistance in each of the unit current sources. Accordingly, the feedback voltage can be provided as a multiplexed representation of all of the feedback voltages of each of the unit current sources 20 at a single node (i.e., the feedback node), thus providing a substantial average of offsets and mismatches associated with the respective individual feedback voltages.

Based on the implementation of the distributed sense resistance in each of the unit current sources 20 to provide interpolative feedback, the LED control system 10 can utilize a constant current source to provide the substantially constant reference current in the driver system 14. As a result, the reference voltage can be held substantially constant to maintain a minimum dropout voltage associated with the LED 12 (e.g., 75 mV), such as at a pin of the associated IC package to which the LED 12 is coupled. In addition, based on the regulation of the substantially constant reference voltage with the interpolative feedback voltage provided from each activated one of the unit current sources 20, the driver system 14 can include only a single error amplifier to substantially mitigate drift errors and amplifier offset associated with the driver system 14. Furthermore, based on the digital implementation of providing the current through the LED 12 based on providing the given unit currents via selective activation of the respective unit current sources 20 in response to the current magnitude signal MAG, the LED control system 10 can be implemented in a more simplistic and cost effective manner than typical analog control solutions, and without the switching noise associated with typical pulse-width control regulation techniques.

Figure 2:
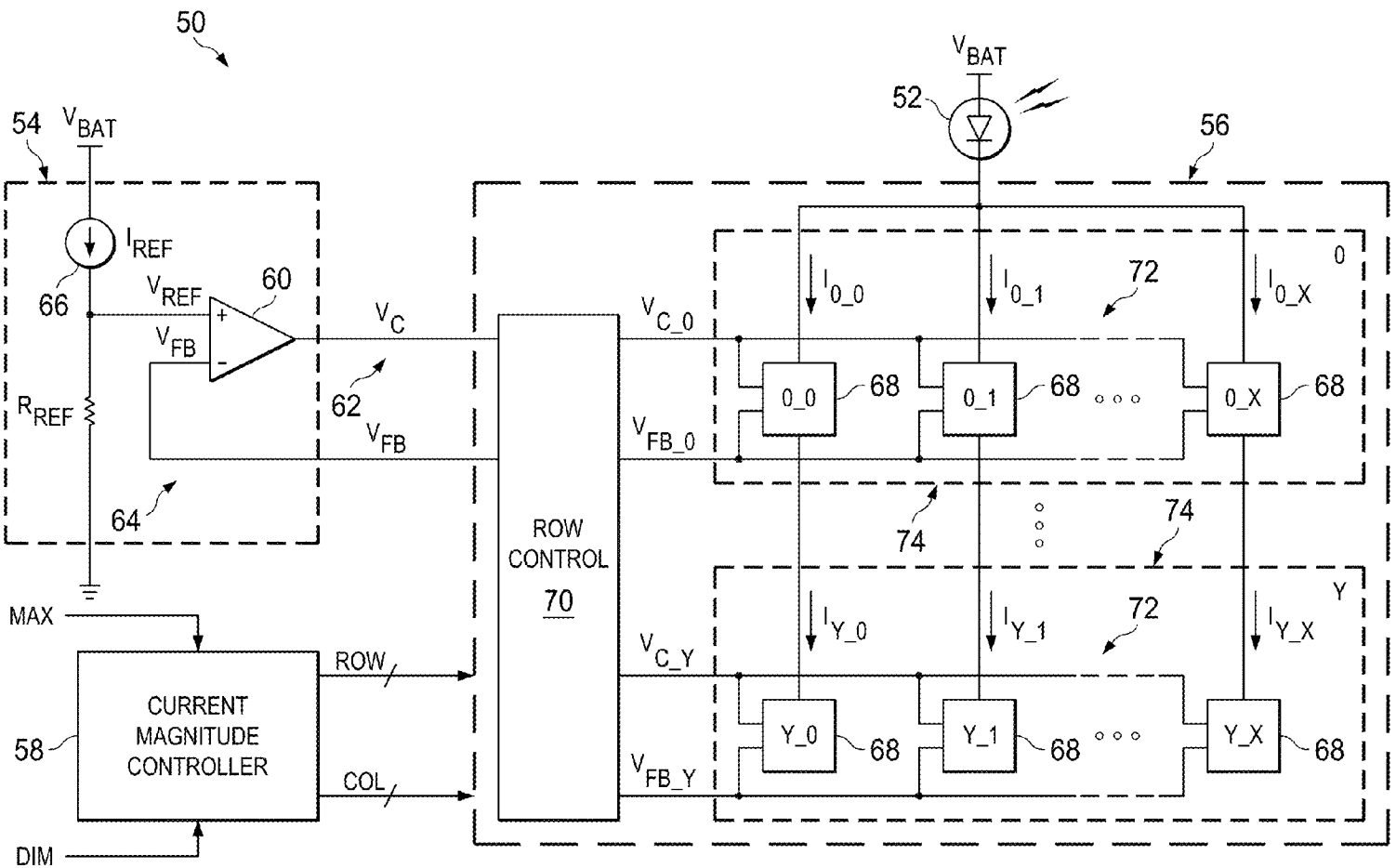
FIG. 2 illustrates another example of an LED control system in accordance with an aspect of the invention.

FIG. 2 illustrates another example of an LED control system 50 in accordance with an aspect of the invention. Similar to as described previously in the example of FIG. 1, the LED control system 50 can be configured to control a brightness of an LED 52 in a variety of electronic applications. In the example of FIG. 2, the LED control system 50 includes a driver system 54, a digital current source system 56, and a current magnitude controller 58. The driver system 54 includes an error amplifier 60 configured to generate a control voltage $V_C$ at a control node 62 based on a relative magnitude of a reference voltage $V_{REF}$ and a feedback voltage $V_{FB}$ at a feedback node 64. The reference voltage $V_{REF}$ is generated based on the flow of a substantially constant reference current $I_{REF}$ through a reference resistor $R_{REF}$. The substantially constant reference current $I_{REF}$ can be provided, for example, from a current source 66 via a battery voltage $V_{BAT}$. The feedback voltage $V_{FB}$ is demonstrated as being provided by the digital current source system 56.

The digital current source system 56 includes a plurality of unit current sources 68 that are arranged in a two-dimensional array that includes a plurality Y of rows and a plurality X of columns, where X and Y are positive integers. In the example of FIG. 2, the unit current sources 68 are demonstrated as labeled in "row_column" format. A first of the Y rows is demonstrated as row "0", such that the unit current sources 68 in row "0" are labeled from the "0" column to the "X" column as "0_0" to "0_X". Similarly, a last of the Y rows is demonstrated as row "Y", such that the unit current sources 68 in row "Y" are labeled from the "0" column to the "X" column as "Y_0" to "Y_X". The unit current sources 68 can each be arranged substantially the same, such that the unit current sources 68 can each be selectively activated by the current magnitude controller 58 to provide a given unit current flow $I_U$ through the LED 52. As described herein, a given one unit current is denoted $I_U$, whereas a specific one of the unit currents $I_U$ that corresponds to a specific one of the unit current sources 68 is denoted by the specific unit current source 68. Thus, in the example of FIG. 2, each of the unit currents $I_U$ are demonstrated as corresponding to a respective one of the unit current sources 68, such that the unit currents $I_U$ in the "0" row are demonstrated as $I_{0_0}$ through $I_{0_X}$ and the unit currents $I_U$ in the "Y" row are demonstrated as $I_{Y_0}$ through $I_{Y_X}$. Each of the unit currents $I_U$ can have approximately t he same magnitude to provide a digital current magnitude control through the LED 52 based on the number of activated unit current sources 68.

Each of the rows of the array of the unit current sources 68 can correspond to a gradation of a maximum current setting through the LED 52. For example, each of the Y rows can correspond to a draw of predetermined magnitude of current through the LED 52 (e.g., 5 mA) if all of the unit current sources 68 were activated in the given row. The current magnitude controller 58 is demonstrated as receiving a maximum current signal MAX and a dimming signal DIM that can collectively correspond to the current magnitude signal MAG in the example of FIG. 1. The maximu m current signal MAX can thus dictate a maximum current magnitude setting for the LED 52, and the dimming signal DIM can correspond to a setting that dictates the portion of the maximum current that is to flow through the LED 52 for dimming control. As an example, the maximum current signal MAX can correspond to a user setting for brightness of a screen for a portable electronic device, and the dimming signal DIM can correspond to a programmable setting for reducing the brightness of the screen based on timed inactivity and/or certain features of the portable electronic device. The maximum current signal MAX and the dimming signal DIM can be digital signals, for example, such that the current magnitude controller 58 can include at least one decoder for generating row activation signals ROW and column activation signals COL. For example, the maximum current signal MAX can be a three bit digital signal to set the maximum current through the LED 52 in predefined increments (e.g., between approximately 0 mA and approximately 30 mA in 5 mA increments). As another example, the dimming signal DIM can be a five bit digital signal to set the dimming as a percentage of the set maximum current magnitude in predetermined increments (e.g., between approximately 0% and 100% in approximately 3.23% increments).

In the example of FIG. 2, the digital current source system 56 includes a row controller 70 that is configured to activate a given one or more of the rows to set a maximum current that can flow through the LED 52 at a given time based on the row activation signals ROW. For example, the row controller 70 can include sets of switches that can couple a control node 72 that is associated with each of the unit current sources 68 in a given row with the control node 62 and sets of switches that can couple a feedback node 74 with that is associated with each of the unit current sources 68 in a given row with the feedback node 64. Therefore, upon activation of a given row, the control voltage $V_c$ can be provided to the control node 72 that is associated with each of the unit current sources 68 in a given row, and a feedback node 64 that is associated with each of the unit current sources 68 in a given row can be provided to the feedback node 64. In the example of FIG. 2, the control voltage and the feedback voltage that are associated with each of the unit current sources 68 in a given row is demonstrated as corresponding to the row number. Thus, in response to the first row (e.g., row "0") being activated by the row controller 70, the control voltage $V_C$ is provided to each of the unit current sources 68 in the first row as the control voltage $V_{C_0}$, and the feedback voltage $V_{FB_0}$ associated with each of the unit current sources 68 can be provided to the feedback node 64 as the feedback voltage $V_{FB}$.

To provide dimming control, the current magnitude controller 58 can generate the column activation signals COL based on the dimming signal DIM to selectively activate a number of the unit current sources 68 in each of the activated rows. For example, if the set maximum current through the LED 52 is desired, the column activation signals COL can activate all of the unit current sources 68 in each of the activated rows to draw the respective unit currents $I_U$ through the LED 52. As another example, if less than all of the set maximum current is desired, such as based on a defined dimming operation, the column activation signals COL can activate less than all of the unit current sources 68 in each of the activated rows to draw the respective unit currents $I_U$ through the LED 52. The unit current sources 68 that are activated in each of the activated rows can all be in the same column, such that the same column activation signal COL can be asserted to activate all of the unit current sources 68 in the given column of the activated rows. Therefore, the respectively activated unit current sources 68 can be activated to provide the respective unit currents $I_U$ from the battery voltage $V_{BAT}$ through the LED 52.

Figure 3:
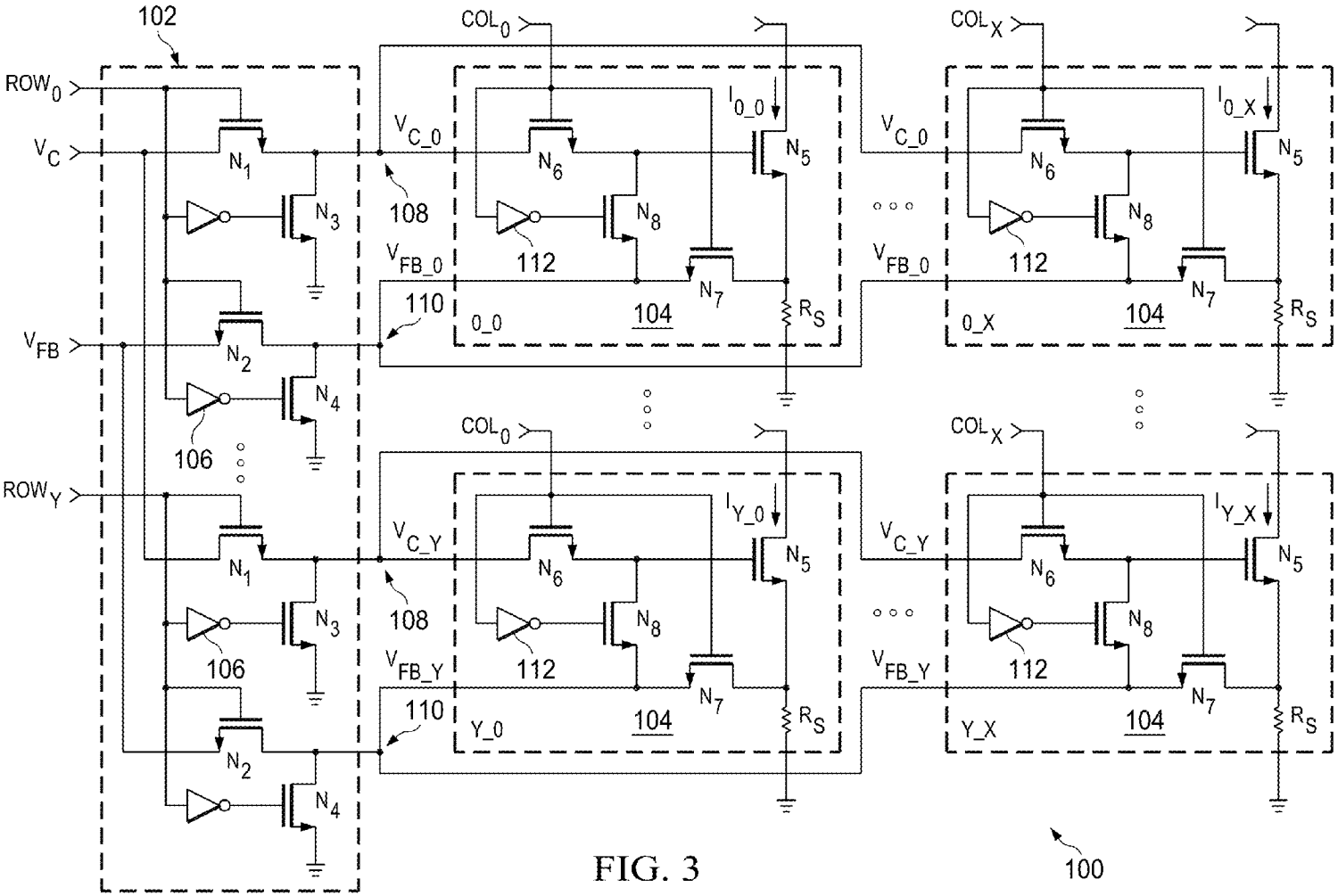
FIG. 3 illustrates an example of a digital current source system in accordance with an aspect of the present invention.

FIG. 3 illustrates an example of a digital current source system 100 in accordance with an aspect of the present invention. The digital current source system 100 can correspond to the digital current source system 58 in the example of FIG. 2. Therefore, reference is to be made to the example of FIG. 2 in the following description of the example of FIG. 3.

The digital current source system 100 includes a row controller 102 and a plurality of unit current sources 104 that are arranged in a two-dimensional array that includes the plurality Y of rows and a plurality X of columns, demonstrated as being labeled and providing the same unit currents as demonstrated in the example of FIG. 2. The unit current sources 104 are arranged substantially the same, such that the unit current sources 104 can each be selectively activated by the current magnitude controller 58 to provide the given unit current flow $I_U$ through the LED 52. Each of the unit currents $I_U$ can have approximately the same magnitude to provide a digital current magnitude control through the LED 52 based on the number of activated unit current sources 104.

The row controller 102 is configured to activate a given one or more of the rows to set a maximum current that can flow through the LED 52 at a given time based on row activation signals $ROW_0$ through $ROW_Y$, corresponding respectively to the rows. For each row, the row controller 102 includes a first switch $N_1$ and a second switch $N_2$ that are activated in response to assertion of the respective row signal ROW, and a third switch $N_3$ and a fourth switch $N_4$ that are deactivated in response to assertion of the respective row signal ROW based on respect inverters 106. The switches $N_1$ through $N_4$ are demonstrated in the example of FIG. 3 as being N-type metal-oxide semiconductor field-effect transistors (MOSFETs), but it is to be understood that any of a variety of different types of switches can be implemented. In response to assertion of the respective row signal ROW to activate of the respective row, the switch $N_1$ is activated to couple the control voltage $V_C$ (e.g., at the control node 62 in the example of FIG. 2) to a control node 108 that is associated with each of the unit current sources 104 in a given row to provide the respective one of the control voltages $V_{C_0}$ through $V_{C_Y}$. Similarly, in response to assertion of the respective row signal ROW, the switch $N_2$ is activated to couple a respective one of the feedback voltages $V_{FB_0}$ through $V_{FB_Y}$ at a feedback node 110 that is associated with each of the unit current sources 104 in a given row with the feedback voltage $V_{FB}$ (e.g., at the feedback node 64 in the example of FIG. 2). In response to the respective row signal ROW being de-asserted to deactivate of the respective row, the switches $N_3$ and $N_4$ are activated to sink the control node 108 and the feedback node 110 associated with the respective deactivated rows to a low-voltage rail (e.g., ground) to set the respective control voltages $V_{C_0}$ through $V_{C_Y}$ and feedback voltages $V_{FB_0}$ through $V_{FB_Y}$ of the deactivated rows to approximately zero.

In the example of each of the unit current sources 104 includes a current switch $N_5$, a pass-switch $N_6$, and two feedback switches $N_7$ and $N_8$. When a given one of the rows "0" through "Y" is activated, the control voltage $V_C$ is provided to the respective control node 108 via the row controller 102. Therefore, in response to assertion of the respective column signal COL to activate the unit current sources 104 of the activated rows, the pass-switch $N_6$ and the feedback switch $N_7$ are activated. The activation of the pass-switch $N_6$ provides the respective control voltages $V_{C_0}$ through $V_{C_Y}$ of the activated rows to a control terminal (e.g., gate) of the current switch $N_5$, thus activating the current switch $N_5$. In response to the activation of the current switch $N_5$, the respective unit current $I_U$ flows from the battery voltage $V_{BAT}$ through the LED 52 and through a sense resistor $R_S$ to the low-voltage rail (e.g., ground). Thus, the unit currents $I_U$ of the activated unit current sources 104 in the respective activated rows contribute to the brightness of the LED 52. In addition, the activation of the feedback switch $N_7$ couples the sense resistor $R_S$ to the feedback node 110, such that the voltage across the sense resistor $R_S$ resulting from the flow of the unit current $I_U$ though the sense resistor $R_S$ provides the respective feedback voltages $V_{FB_0}$ through $V_{FB_Y}$ of the activated rows. As a result, as a result of the coupling of the feedback nodes 110 of the activated rows to the feedback node 64 based on the row controller 102, the feedback node 64 is provided the feedback voltage $V_{FB}$ in an interpolative manner. As a result, the feedback voltage $V_{FB}$ can be provided as a multiplexed representation of all of the feedback voltages $V_{FB_0}$ through $V_{FB_Y}$ of each of the unit current sources 104 of the each of the activated rows at the feedback node 64, thus providing a substantial average of offsets and mismatches associated with the respective individual feedback voltages $V_{FB_0}$ through $V_{FB_Y}$ of each of the unit current sources 104 of the each of the activated rows. Additionally, a minimum dropout voltage associated with the LED 52 (e.g., 75 mV) can be maintained, such as at a pin of the associated IC package to which the LED 52 is coupled, and the driver system 54 can include only a single error amplifier (e.g., the error amplifier 60 to substantially mitigate drift errors and amplifier offset associated with the driver system 54.

In response to de-assertion of the respective column signal COL to deactivate the unit current sources 104 of the activated rows, the pass-switch $N_6$ and the feedback switch $N_7$ are deactivated and the feedback switch $N_8$ is activated via an inverter 112. The deactivation of the pass-switch $N_6$ removes the respective control voltages $V_{C_0}$ through $V_{C_Y}$ of the activated rows from the control terminal of the current switch $N_5$, thus deactivating the current switch $N_5$ to cease the respective unit current $I_U$ from being provided through the LED 52. In addition, the activation of the feedback switch $N_g$ couples the control terminal of the current switch $N_5$ to the feedback node 110, and the deactivation of the switch $N_7$ decouples the sense resistor $R_S$ from the feedback node 110. Accordingly, the current switch $N_5$ remains deactivated, and the voltage across the respective sense resistor $R_S$ is no longer provided in an interpolative manner to the respective feedback voltages $V_{FB_0}$ through $V_{FB_Y}$ of the activated rows. Accordingly, the unit current sources 104 can be selectively activated and deactivated to provide dimming control of the LED 52 with respect to activation of a portion of the unit current sources 104 in a given activated row.

It is to be understood that the digital current source system 100 is not intended to be limited to the example of FIG. 3. For example, the switching control scheme of the row controller 102 and/or the unit current sources 104 can be provided in any of a variety of different ways to provide activation of the specific rows and/or columns, respectively, of the unit current sources 104. Accordingly, the digital current source system 100 can be implemented in any of a variety of ways.

Figure 4:
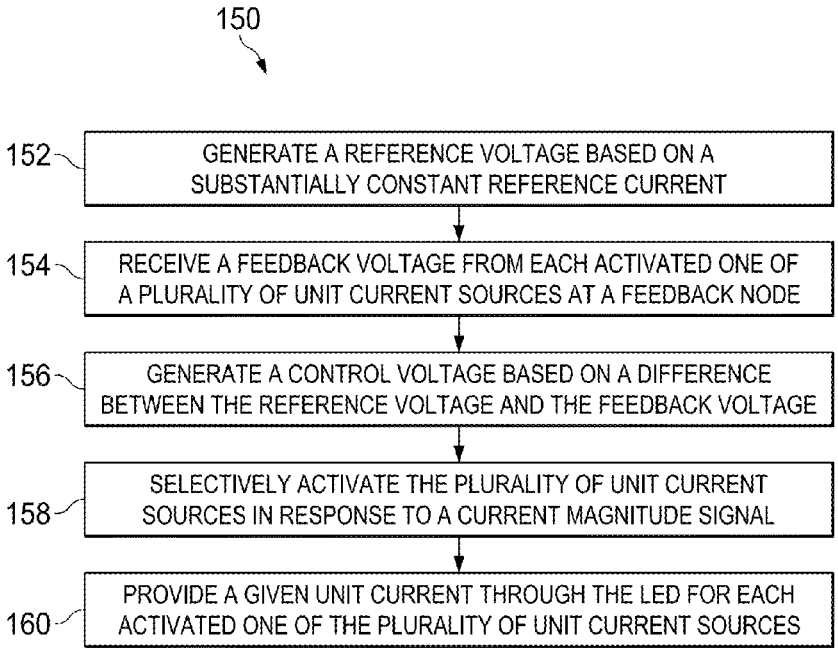
FIG. 4 illustrates an example of a method for controlling an LED in accordance with an aspect of the present invention.

In view of the foregoing structural and functional features described above, certain methods will be better appreciated with reference to FIG. 4. It is to be understood and appreciated that the illustrated actions, in other embodiments, may occur in different orders and/or concurrently with other actions. Moreover, not all illustrated features may be required to implement a method.

FIG. 4 illustrates an example of a method 150 for controlling an LED (e.g., the LED 12) in accordance with an aspect of the present invention. At 152, a reference voltage (e.g., the reference voltage $V_{REF}$) is generated based on a substantially constant reference current (e.g., the current $I_{REF}$). At 154, a feedback voltage (e.g., the feedback voltage $V_{FB}$) is received from each activated one of a plurality of unit current sources (e.g., the plurality of unit current sources 68) at a feedback node (e.g., the feedback node 64). At 156, a control voltage (e.g., the control voltage $V_C$) is generated based on a difference between the reference voltage and the feedback voltage. At 158, the plurality of unit current sources are selectively activated in response to a current magnitude signal (e.g., the current magnitude signal MAG). At 160, a given unit current (e.g., the unit currents $I_U$) through the LED is provided for each activated one of the plurality of unit current sources.

What have been described above are examples of the invention. It is, of course, not possible to describe every conceivable combination of components or method for purposes of describing the invention, but one of ordinary skill in the art will recognize that many further combinations and permutations of the invention are possible. Accordingly, the invention is intended to embrace all such alterations, modifications, and variations that fall within the scope of this application, including the appended claims.

What is claimed is:

1. A light-emitting diode (LED) control system comprising:

an LED driver system configured to regulate a control voltage based on a substantially constant reference current and a feedback voltage at a feedback node;

a digital current source system comprising a plurality of unit current sources that are each coupled to an LED, the plurality of unit current sources being selectively activated to each provide a given unit current through the LED and to each provide the feedback voltage as an interpolative feedback to the feedback node based on the unit current; and a current magnitude controller configured to selectively activate the plurality of unit current sources in response to a current magnitude signal, wherein the plurality of unit current sources are arranged in a two-dimensional array comprising a plurality of rows and a plurality of columns, each of the plurality of rows comprising a first quantity of the plurality of unit current sources and each of the plurality of columns comprising a second quantity of the plurality of unit current sources.

2. The system of claim 1, wherein the digital current source system comprises a row controller configured to control selective activation of the plurality of rows based on the current magnitude signal to provide the control voltage to each of a selectively activated at least one of the first quantity of the plurality of unit current sources and to receive the feedback voltage from each of the selectively activated at least one of the first quantity of the plurality of unit current sources.

3. The system of claim 1, wherein each of the plurality of rows of the two-dimensional array is associated with a predetermined digital magnitude of current through the LED, wherein the current magnitude controller is configured to activate at least one of the first quantity of the plurality of unit current sources in each of at least one of the second quantity of the plurality of unit current sources in response to the current magnitude signal.

4. The system of claim 3, wherein the current magnitude signal comprises a maximum current signal and a dimming signal, wherein a number of the at least one of the second quantity of the plurality of unit current sources is determined by the maximum current signal and a number of the at least one of the first quantity of the plurality of unit current sources in each of the at least one of the second quantity of the plurality of unit current sources is determined by the dimming signal.

5. The system of claim 1, wherein each of the plurality of unit current sources comprises a current switch that is coupled to the LED and that is arranged in series with a sense resistor, the switch being activated based on the current magnitude signal to provide the given unit current through the LED, the sense resistor being configured to generate the feedback voltage in response to the providing of the given unit current through the LED.

6. The system of claim 5, wherein each of the plurality of unit current sources further comprises:

a pass-switch that is activated based on the current magnitude signal to provide the control voltage to the current switch to activate the current switch; and at least one feedback switch configured to provide the feedback voltage to the LED driver system in response to activation of the pass-switch and to deactivate the current switch in response to deactivation of the pass-switch.

7. The system of claim 1, wherein the LED driver system comprises a reference resistor configured to generate a reference voltage based on the substantially constant reference current, and wherein each of the plurality of unit current sources comprises a sense resistor configured to generate the feedback voltage in response to the selective activation of the respective one of the plurality of unit current sources, wherein the reference resistor and the sense resistor have relative resistance magnitudes that are proportional.

8. The system of claim 1, wherein the plurality of unit current sources are arranged in a two-dimensional array comprising a plurality of rows and a plurality of columns, wherein the current magnitude signal comprises a first digital signal comprising X bits, the first digital signal corresponding to activation of a number of the plurality of rows to set a maximum current flow through the LED, and wherein the current magnitude signal further comprises a second digital signal comprising Y bits, the second digital signal corresponding to activation of a number of the plurality of unit current sources in each activated row to provide a current flow through the LED as a portion of the maximum current flow.

9. An integrated circuit (IC) chip comprising the LED control system of claim 1.

10. A method for controlling a light-emitting diode (LED), the method comprising:

generating a reference voltage based on a substantially constant reference current;

receiving a feedback voltage from each activated one of a plurality of unit current sources as an interpolative feedback at a feedback node;

generating a control voltage based on a difference between the reference voltage and the feedback voltage at the feedback node;

selectively activating the plurality of unit current sources in response to a current magnitude signal; and providing a given unit current through the LED for each activated one of the plurality of unit current sources, wherein the plurality of unit current sources are arranged in a two-dimensional array comprising a plurality of rows and a plurality of columns, wherein selectively activating the plurality of unit current sources comprises:

activating a number of the plurality of rows to set a maximum current flow through the LED based on a first digital portion of the current magnitude signal; and activating a number of the plurality of unit current sources in each activated row to provide a current flow through the LED as a portion of the maximum current flow based on a second digital portion of the current magnitude signal.

11. The method of claim 10, wherein activating the number of the plurality of rows comprises:

activating a first switch to provide the control voltage to a control node associated with each of the plurality of unit current sources; and activating a second switch to couple the feedback node to a feedback node associated with each of the plurality of unit current sources.

12. The method of claim 10, wherein selectively activating the plurality of unit current sources comprises activating a current switch in each activated one of the plurality of unit current sources, the current switch being coupled to the LED and that is arranged in series with a sense resistor; and generating the feedback voltage in response to the providing of the given unit current through a sense resistor coupled in series to the current switch.

13. The method of claim 10, wherein activating the current switch comprises activating a pass-switch based on the current magnitude signal to provide the control voltage to the current switch.

14. The method of claim 10, wherein receiving the feedback voltage comprises:

activating a first feedback switch in each activated one of the plurality of unit current sources to couple a sense resistor associated with the respective activated one of the plurality of unit current sources to the feedback node; and deactivating a second feedback switch that interconnects the feedback node and a control terminal of a pass-switch through which the given unit current flows in each activated one of the plurality of unit current sources.

15. The method of claim 10, wherein generating the reference voltage comprises providing the substantially constant reference current through a reference resistor, and wherein receiving the feedback voltage comprises providing the given unit current in each activated one of the plurality of unit current sources through a sense resistor in each activated one of the plurality of unit current sources, wherein the reference resistor and the sense resistor have relative resistance magnitudes that are proportional.

16. A light-emitting diode (LED) control system comprising:

an LED driver system configured to regulate a control voltage based on comparing a reference voltage with a feedback voltage at a feedback node, the reference voltage being generated based on a substantially constant reference current provided through a reference resistor;

a current magnitude controller configured to decode a maximum current signal and a dimming signal to generate a row activation signals and a column activation signals, respectively; and a digital current source system comprising a plurality of unit current sources that are each coupled to an LED, the plurality of unit current sources being arranged in a two-dimensional array comprising a plurality of rows and a plurality of columns, the plurality of rows being selectively activated based on the row activation signals and the plurality of unit current sources in each activated one of the plurality of rows being selectively activated based on the column activation signals to each provide a given unit current through the LED and to each provide the feedback voltage as an interpolative feedback to the feedback node based on the given unit current being provided through a sense resistor in each activated one of the plurality of unit current sources, the reference resistor and the sense resistor of each of the plurality of unit current sources having relative resistance magnitudes that are proportional.

17. The system of claim 16, wherein the row activation signals corresponds to activation of a number of the plurality of rows to set a maximum current flow through the LED and wherein the column activation signals corresponds to activation of a number of the plurality of unit current sources in each activated one of the plurality of rows to provide a current flow through the LED as a portion of the maximum current flow.

18. The system of claim 16, wherein each of the plurality of unit current sources comprises:

a current switch that is coupled to the LED and that is arranged in series with the sense resistor;

a pass-switch that is activated based on the column activation signals to provide the control voltage to the current switch to activate the current switch; and at least one feedback switch configured to provide the feedback voltage to the LED driver system in response to activation of the pass-switch and to deactivate the current switch in response to deactivation of the pass-switch.

* * * * *